United States Patent [19]

Borgquist

[11] Patent Number: 4,807,405

[45] Date of Patent: Feb. 28, 1989

[54] GEODESIC INFLATABLE STRUCTURE, AND METHODS OF CONSTRUCTING AND UTILIZING SAME

[76] Inventor: Ronald B. Borgquist, 2133 Lawndale, West Bloomfield, Mich. 48033

[21] Appl. No.: 87,294

[22] Filed: Aug. 20, 1987

[51] Int. Cl.[4] ..... E04B 1/32

[52] U.S. Cl. ..... 52/2; 52/81

[58] Field of Search ..... 52/2, 81

[56] References Cited

U.S. PATENT DOCUMENTS

| | | | |
|---|---|---|---|
| 2,656,844 | 10/1953 | Krenzer | 52/2 J |
| 2,812,769 | 11/1957 | Schaefer | 52/2 E |
| 2,946,337 | 7/1960 | Wolshin | 52/2 K |
| 3,338,001 | 8/1967 | Fraser | 52/2 K |
| 3,742,658 | 7/1973 | Meyer | 52/2 K |
| 3,973,363 | 8/1976 | La Porte | 52/2 J |
| 4,076,872 | 2/1978 | Lewicki | 52/2 J |
| 4,114,325 | 9/1978 | Hochstein | 52/2 K |

FOREIGN PATENT DOCUMENTS

| | | | |
|---|---|---|---|
| 2634873 | 2/1978 | Fed. Rep. of Germany | 52/2 K |
| 2104934 | 3/1983 | United Kingdom | 52/2 K |

*Primary Examiner*—Henry E. Raduazo

*Attorney, Agent, or Firm*—Irving M. Weiner; Roland W. Norris; Joseph P. Carrier

[57] ABSTRACT

A geodesic inflatable structure having a lattice-like support framework defined by a multiplicity of inflatable tubular ribs. Triangular frame sections defined by the ribs each support one of a multiplicity of inflatable panels having inner and outer plies defining an inflation chamber therein. When inflated with pressurized air or another inflation substance, the inflatable ribs and panels form a geodesic dome structure.

10 Claims, 1 Drawing Sheet

GEODESIC INFLATABLE STRUCTURE, AND METHODS OF CONSTRUCTING AND UTILIZING SAME

BACKGROUND OF THE INVENTION

1. Field of the Invention

The present invention relates generally to a geodesic inflatable structure for use, for example, as a tent. More particularly, the invention relates to a geodesic inflatable structure having a lattice-like framework of inflatable rib members supporting a multiplicity of inflatable panel members. The structure is readily inflatable by a suitable substance under pressure, such as pressurized air, and is entirely self-supported in its inflated state.

2. Description of Relevant Art

Users of tents and other similar enclosures often encounter problems with respect to transporting, erecting, and disassembling such structures. Ofttimes, such structures require a number of rigid pole members which greatly hinder transportation thereof, and which complicate erection of the structure. In addition, when such pole members are assembled as a rigid external framework for the tent or similar enclosure, the connecting portions (ties, etc.) between the framework and the canopy member are subjected to considerable stress and wear. The pole members themselves can also become bent and thus difficult or impossible to use.

In addition, conventional tents and similar enclosures have in many cases proven defective in providing adequate insulation to properly protect users thereof from inclement weather conditions.

Attempts to overcome the foregoing problems have included the provision of structures with inflatable support members or portions. Illustrative ones of such structures are described below.

The "Inflatable Building Construction" disclosed in U.S. Pat. No. 3,945,156 issued in 1976 to Hamm comprises a geodesic dome structure having a skeleton of lattice-like support elements with a fabric-like canopy laid thereover. To act as a buffer between the frame and the canopy, gasfilled ball-like cushions are provided at juncture points of the frame.

The "Inflatable Enclosure" disclosed in U.S. Pat. No. 3,999,333 issued in 1976 to Amarantos comprises an inflatable structure including a hollow header portion attachable to a floor or other base and having spaced first and second sheets secured thereto. Tubes are bonded to the interior surfaces of the sheets, with first ends of the tubes in communication with valved apertures in the header. The second ends of the tubes communicate with the apertured bottom of a cup-shaped member which is closed by a plug. The tubes are inflated by pressurized gas discharged into the header.

The "Double Walled Inflatable Structures" disclosed in U.S. Pat. No. 4,004,380 issued in 1977 to Kwake comprise a variety of structures having double walls as portions of structures suitable for use as car ports, hangers, etc. A first and second plastic sheet having a multiplicity of paired holes determine the configuration of the final inflated structure. By placing the plastic sheets opposite one another and mounting a multiplicity of grommeting means provided with segments of cords on the external surfaces of the plastic sheets over the holes, and by extending the segments of cords inwardly, a predetermined structure may be formed. Inflation of the structure is accomplished by blowing air into the enclosure thus formed.

The "Inflatable Structure" disclosed in U.S. Pat. No. 4,114,325 issued in 1978 to Hochstein comprises an inflatable structure for emergency accommodation which includes an inflatable frame unit having square inflatable cushions disposed therebetween.

The "Triple Wall Panel Unit for Air Supported Structure" disclosed in U.S. Pat. No. 4,186,530 issued in 1980 to Fraioli comprises a triple-wall unit panel which is inflatable.

The "Inflatable Tent" disclosed in U.S. Pat. No. 4,384,435 issued in 1983 to Polise comprises a hemispherical inflatable tent having a number of compartments generally provided in the shape of sections of an orange, the sections being inflatable through a manifold in the top of the tent which communicates with each compartment.

The present invention represents an improvement over the above-discussed structures inasmuch as it incorporates an inflatable geodesic dome configuration which inherently reduces stress and weight while affording considerable structural strength. Both the lattice-like network of rib members and the panel members which they support are inflatable, thus eliminating any need for external support members while still assuring structural rigidity by virtue of the geodesic dome shape.

In addition, the overall design of the inflatable structure according to the invention lends itself to inexpensive manufacture; while also facilitating erecting, disassembling, and transporting thereof. By virtue of the inflatable construction of the structure, excellent insulative properties are also attained.

SUMMARY OF THE INVENTION

The present invention provides an inflatable structure comprising a plurality of inflatable rib members arranged in a lattice-like framework, and a plurality of inflatable panel members each supported within a frame section defined by a plurality of the rib members. Valve means communicate with the rib members and the panel members for supplying a substance under pressure (such as pressurized air) to inflation chambers defined within the rib and panel members. The inflatable structure is dome-shaped in its inflated state, and in the preferred embodiment has a geodesic dome shape wherein each frame section is defined by three rib members arranged in a substantially equilateral triangle configuration.

It is an object of the invention to provide an inflatable structure wherein the supporting framework defined by the rib members, as well as the panel members supported thereby, are readily inflatable by pressurized air (for example).

A further object of the invention is to provide a geodesic dome structure wherein essentially all structural members are inflatable so as to facilitate erecting, disassembling, transport and storage of the structure, while ensuring structural strength and adequate insulation.

To enhance the strength and insulative properties of the structure according to the invention, various embodiments thereof incorporate multiple-ply constructions which may range from a two-ply construction to a five-ply construction, for example.

The above and further objects, details and advantages of the present invention will become apparent from the following detailed description, when read in conjunction with the accompanying drawings.

DETAILED DESCRIPTION OF PREFERRED EMBODIMENTS

Figure 1:
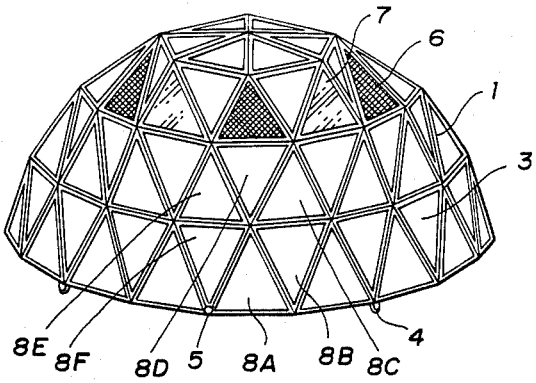
FIG. 1 illustrates a perspective view of a geodesic inflatable structure according to a preferred embodiment of the invention.
Figure 2:
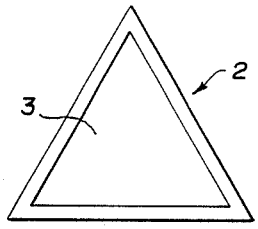
FIG. 2 depicts a single triangular frame section of the structure in FIG. 1.

With reference to FIG. 1, there is shown a geodesic inflatable structure according to the invention, in its inflated state. The main support portion of the structure comprises a lattice-like framework of inflatable rib members 1, arranged so as to form a multiplicity of substantially equilateral triangles. Each of the triangular sections of the framework formed by ribs comprises a frame section 2 (FIG. 2) supporting an inflatable panel member 3. As shown in FIG. 1, a multiplicity of the frame sections 2 respectively support a multiplicity of the panels 3 in the general configuration of a geodesic dome. By virtue of the geodesic dome shape of the inflated structure, stress is reduced and structural strength is enhanced.

Although not shown in FIG. 1, the geodesic inflatable structure according to the invention also desirably includes an integral floor portion formed of a suitable waterproof or water-resistant material such as plastic, for example. The inflatable ribs 1 and inflatable panels 3 are formed of any suitable lightweight sheet material which is capable of containing air or another inflation substance therein. The seams between the ribs 1 and panels 3 may be formed, for example, by heat-sealing or any other suitable method.

As also shown in FIG. 1, the geodesic inflatable structure according to the invention is provided with a plurality of lower loops 4 adapted to receive therethrough, for example, tent stakes for fastening the structure to a ground surface. To this end, the loops 4 are arranged at circumferentially spaced intervals around the lower periphery of the structure. At least one, and preferably a plurality, of valved apertures 5 are provided for supplying pressurized air or another inflation substance to inner chambers of the inflatable members in a manner to be described in detail hereinbelow.

It is desirable that at least one of the frame sections 2 be provided with a screen member 6 which preferably has a zippered closure therebehind for selectively opening and closing the frame section with a panel 3 or another suitable closure member disposed inwardly of screen 6. Preferably, at least one window member 7 is also provided in the structure, the window 7 being formed of clear plastic, for example, and also having a zippered closure member disposed inwardly thereof.

A door member for the geodesic structure is readily formed by providing a zippered opening around, for example, an adjacent six of the frame sections 2, such as sections 8A, 8B, 8C, 8D, 8E and 8F shown in FIG. 1. With such a door arrangement, it is desirable that the ribs 1 and panels 3 defining the door closure be inflatable as a unit separately from the remainder of the structure, as will be described hereinbelow.

With reference to FIGS. 3–7, there will now be described various alternative multiple-ply constructions of inflatable ribs 1 and inflatable panels 3.

Figure 3:
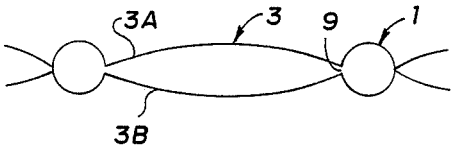
FIG. 3 is a cross-sectional view showing a basic two-ply construction of the inflatable structure according to the invention.

FIG. 3 depicts a basic two-ply construction of ribs 1 and panels 3, wherein ribs 1 have a substantially tubular configuration when inflated, and panels 3 have inner and outer convex portions when inflated, defined by inner and outer plies of material 3A and 3B. With such construction, each of the ribs and panels 3 have a single inflation chamber defined therein. The respective inflation chambers of ribs 1 and panels 3 communicate with each other via conduits 9 which are defined as spaced perforations extending through the seam portions between ribs 1 and panels 3. As many of such perforations are provided as are necessary to permit adequate air flow between ribs 1 and panels 3 during inflation and deflation of the structure.

It will be understood that the air communication between the multiplicity of ribs i and between the ribs 1 and panels 3 may be defined in any desired manner to facilitate inflation and deflation of the structure. In this respect, it is desirable that a plurality of separate inflation sections are each defined by a series of ribs 1 and panels 3 which are in fluid communication with each other without communicating with ribs and panels of other inflation sections. To this end, the communication between ribs 1 and panels 3 may be arranged such that two, three or more separate inflation sections are provided. Preferably, the ribs and panels (such as 8A–8F) forming the door closure are arranged as a separate inflation section.

Figure 4:
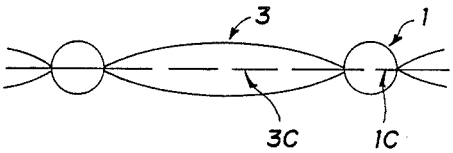
FIG. 4 is a cross-sectional view showing a three-ply construction of the inflatable structure according to the invention.

Each of the separate inflation sections is provided with a valved aperture 5 for supplying pressurized air or another inflation substance to a given section. Also provided for each section is at least one air relief valve for deflation purposes. With reference to FIG. 4, there is shown an alternative construction of ribs 1 and panels 3. In this arrangement, a central ply of material 3C extends transversely through panel 3 and a coplanar central ply 1C extends through rib 1. Both central plies 3C and 1C are provided with spaced perforations as shown in FIG. 4, to permit fluid communication through the central plies for inflation and deflation purposes.

Figure 5:
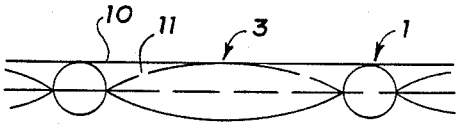
FIG. 5 is a cross-sectional view showing a four-ply construction according to the invention.

FIG. 5 shows another alternative construction of ribs 1 and panels 3 wherein an external ply of material 10 is applied on the outer side of ribs 1 and panels 3 adding to the construction of FIG. 4. The external ply 10 defines an outer skin for the structure, and may be heat sealed to central outer portions of ribs 1 and panels 3 as shown in FIG. 5. If desired, perforations 11 may be formed in the outer ply of panel 3 to permit fluid communication to the chambers defined by the outer surfaces of ribs 1 and panels 3 and the inner surface of exterior ply 10.

Figure 6:
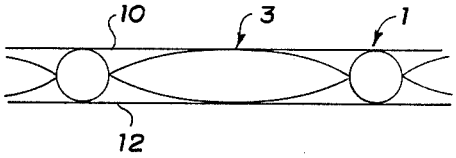
FIG. 6 is a cross-sectional view showing a four-ply construction according to the invention.

In FIG. 6, there is provided an internal ply of material 12 in addition to the external ply 10. Internal ply 11 may be fixed to ribs 1 and panels 3 at central inner portions thereof as shown, and if desired perforations may be formed in the inner ply of panel 3 to permit fluid communication as described with reference to FIG. 5.

Figure 7:
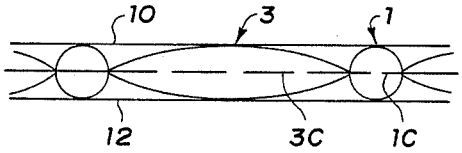
FIG. 7 is a cross-sectional view showing a five-ply construction according to the invention.

FIG. 7 shows yet another alternative construction wherein both internal ply 12 and external ply 10 are provided in addition to central plies 3C and 1C. As described with reference to FIG. 4, central plies 3C and 1C are desirably formed with perforations permitting fluid communication between both sides of the central plies. If desired, perforations may also be formed in the inner and outer plies of panel 3 to permit fluid communication as described with reference to FIG. 5.

One of the various configurations shown in FIGS. 3–7 may be selected in accordance with the structural strength and insulative property requirements of the structure for particular uses.

In use, the structure in its deflated condition is spread out so as to be substantially flat on the ground surface. A suitable source of pressurized air, such as a mechanical or electrical air pump, is then connected with each of the valves 5 to inflate the structure section by section. Once the entire structure has been inflated, the tie-down loops 4 may be used to secure the structure to the ground surface via tent stakes or the like.

In disassembling the structure, the user has merely to operate the various air relief valves to deflate the various inflation sections. Thereafter, the deflated structure may be readily rolled or folded into a compact configuration for transport.

The present invention also contemplates the provision of a semi-permanent geodesic inflatable structure wherein a self-hardening foam polymer or similar material is used as an inflation substance in place of pressurized air. To this end, the communication conduits between the various ribs 1 and panels 3 may be suitably arranged to permit free flow of the foam material therethrough.

It will also be understood that the window, screen and door units of the structure may be arranged as desired. Further, it is contemplated that interior divider curtains may be provided for the structure.

Manufacture of the geodesic inflatable structure according to the invention is facilitated by the ability to construct same substantially on a flat surface, thus permitting high volume, low cost production of the structure.

While there have been described what are at present considered to be the preferred embodiments of the invention, it will be understood that many changes and modifications may be made therein without departing from the scope of the appended claims.

I claim:

1. An inflatable structure, comprising:

a plurality of inflatable rib members arranged in a lattice-like framework;

a plurality of inflatable panel members, each said panel member being supported within a frame section defined by a plurality of said inflatable rib members;

valve means communicating with said rib members and said panel members for supplying a substance under pressure to inflation chambers defined within said rib members and said panel members; and said inflatable structure being dome-shaped in its inflate state;

each said frame section supporting each said panel member is defined by three of said inflatable rib members arranged in a substantially equilateral triangle configuration; and said inflatable structure has a geodesic dome shape in its inflated state;

each said rib member is substantially tubular; and each said panel member is formed of at least an inner and an outer ply of material having said inflation chamber defined therebetween;

said panel members are affixed to said rib members by seam portions; and conduits are provided in said seam portions to permit communication between said inflation chambers of said rib members and said inflation chambers of said panel members;

said plurality of inflatable rib members have the inflation chambers thereof intercommunicating so as to define a plurality of inflation sections of said inflatable structure; and each said inflation section of said inflatable structure is provided with at least one said valve means;

each said substantially tubular rib member is formed with a central ply of material extending transversely therethrough;

each said panel member is formed with a central ply of material extending transversely therethrough in substantially coplanar relation to said central ply of said rib members; and said central plies are provided with perforations to permit flow of said substance under pressure therethrough; and an external ply of material extends over at least a plurality of said frame sections.

2. An inflatable structure according to claim 1, wherein:

said outer plies of said panel members are provided with perforations to permit flow of said substance under pressure therethrough.

3. An inflatable structure according to claim 1, wherein:

said external ply is connected to intermediate portions of said outer plies of said panel members, and to outer portions of said rib members.

4. An inflatable structure according to claim 3, wherein:

said outer plies of said panel members are provided with perforations to permit flow of said substance under pressure therethrough.

5. An inflatable structure according to claim 1, wherein:

an internal ply of material extends over at least a plurality of said frame sections on the interior of said inflatable structure.

6. An inflatable structure according to claim 5, wherein:

said external ply of material is connected to intermediate portions of said outer plies of said panel members, and to outer portions of said rib members; and said internal ply of material is connected to intermediate portions of said inner plies of said panel members, and to inner portions of said rib members.

7. An inflatable structure according to claim 1, wherein:

at least one of said frame sections is provided with a screen member; and means are provided for opening and closing said at least one frame section to selectively provide ventilation to the interior of said inflatable structure through said screen member.

8. An inflatable structure according to claim 1, wherein:

at least one of said frame sections is provided with a transparent inflatable panel member defining a window.

9. An inflatable structure according to claim 1, wherein:

a plurality of said frame sections together define a door member.

10. An inflatable structure according to claim 1, wherein:

a plurality of stake-down loops are provided at spaced intervals along a lower peripheral edge of said inflatable structure.

* * * * *

UNITED STATES PATENT AND TRADEMARK OFFICE

CERTIFICATE OF CORRECTION

PATENT NO. : 4,807,405

DATED : February 28, 1989

INVENTOR(S) : Ronald B. Borgquist

It is certified that error appears in the above-identified patent and that said Letters Patent is hereby corrected as shown below:

Column 1, line 44, change "gasfilled" to -- gas-filled--.

Column 3, line 29, after "ribs" insert -- 1 --.

Column 4, line 15, after "ribs" insert -- 1 --.

Column 4, line 25, change "i" to -- 1 --.

Column 5, line 61, (claim 1, line 14), change "inflate" to -- inflated --.

Column 6, line 15, (claim 1, line 36), after "one" add -- of --.

Signed and Sealed this

Thirty-first Day of October, 1989

*Attest:*

*Attesting Officer*

DONALD J. QUIGG

*Commissioner of Patents and Trademarks*